United States Patent [19]

Kumagai

[11] 4,170,805

[45] Oct. 16, 1979

[54] WINDOW GLASS-CLEANING DEVICE

[75] Inventor: Moriji Kumagai, Kitakyushu, Japan

[73] Assignee: Yugen-Gaisha Waikei Giken, Kitakyushu, Japan

[21] Appl. No.: 808,356

[22] Filed: Jun. 20, 1977

[30] Foreign Application Priority Data

Jun. 21, 1976 [JP] Japan ..... 51-73478

[51] Int. Cl.[2] ..... A47L 11/38

[52] U.S. Cl. ..... 15/321; 15/322; 15/353

[58] Field of Search ..... 15/320, 321, 322, 353

[56] References Cited

U.S. PATENT DOCUMENTS

| | | | |
|---|---|---|---|
| Re. 27,792 | 10/1973 | Howerin et al. | 15/321 |
| 1,661,480 | 3/1928 | Keefer | 15/321 |
| 2,233,167 | 2/1941 | Holm-Hansen | 15/353 |
| 2,292,435 | 8/1942 | Crites | 15/321 |
| 2,909,800 | 10/1959 | Grindle et al. | 15/321 |
| 3,195,166 | 7/1965 | Wisner | 15/321 |
| 3,896,520 | 7/1975 | Williams | 15/320 |

FOREIGN PATENT DOCUMENTS

| | | | |
|---|---|---|---|
| 408312 | 9/1966 | Switzerland | 15/321 |

*Primary Examiner*—Christopher K. Moore

*Attorney, Agent, or Firm*—Wenderoth, Lind & Ponack

[57] ABSTRACT

An upright tank partly filled with water is disposed on a wheeled carrier. A box-shaped cover at the top of the tank is provided on the inside with an air exhaust blower and a pump, both are enclosed within an air filter attached to the underside of the cover. A return hose leading to a glass cleaner head opens above the water level within the tank. The pump pumps water percolated by a dirt percolator at the tank bottom to the cleaner through a feed hose to the glass cleaner head extending through the return hose. Dirty air and water from the cleaner return to the tank through the return hose. The blower exhausts the air within the tank therefrom. The exhausted air passes through the air filter.

5 Claims, 2 Drawing Figures

WINDOW GLASS-CLEANING DEVICE

BACKGROUND OF THE INVENTION

This invention relates to improvements in a device for cleaning window glass.

Conventional devices for cleaning window glass leave room for improvement in that the cleaning operation is sanitarily performed, the device is simplified in construction and easy to be handled while the maintenance and control is facilitated.

It is an object of the present invention to provide a new and improved device of simple construction for sanitarily cleaning window glass.

It is another object of the present invention to provide a new and improved device for cleaning window glass which is easy to handle, maintain and control.

SUMMARY OF THE INVENTION

The present invention provides a device for cleaning window glass which is an upright tank having an upper end open and a closed bottom. A cover plate is provided for opening and hermetically closing the upper end of the tank, and an electrically operated air exhaust means and electrically operated water pump means are attached to the inner surface of the cover plate in its closed position. An air filter is mounted on the inner surface of the cover plate to filter air before it is sucked by the air exhaust mean, and a dirt percolator is disposed at the bottom of the tank. A water suction hose is connected to the water pump means and opens into the interior of the dirt percolator. Finally a return hose extends and is sealed through the peripheral wall of the tank and opens into the interior of the tank above the dirt percolator, and a water feed hose is connected to the water pump means and extends through the return hose. The tank is filled with water to a level between the open end of the return hose and the upper surface of the dirt percolator. The pump means sucks water through the dirt percolator and the water suction hose and delivers it to the water feed hose while the air exhaust means operates to return used water and air back to the tank through the return hose and to externally exhaust the air passed through the air filter.

BRIEF DESCRIPTION OF THE DRAWING

The present invention will become more readily apparent from the following detailed description taken in conjunction with the accompanying drawing in which.

DESCRIPTION OF THE PREFERRED EMBODIMENT

Figure 1:
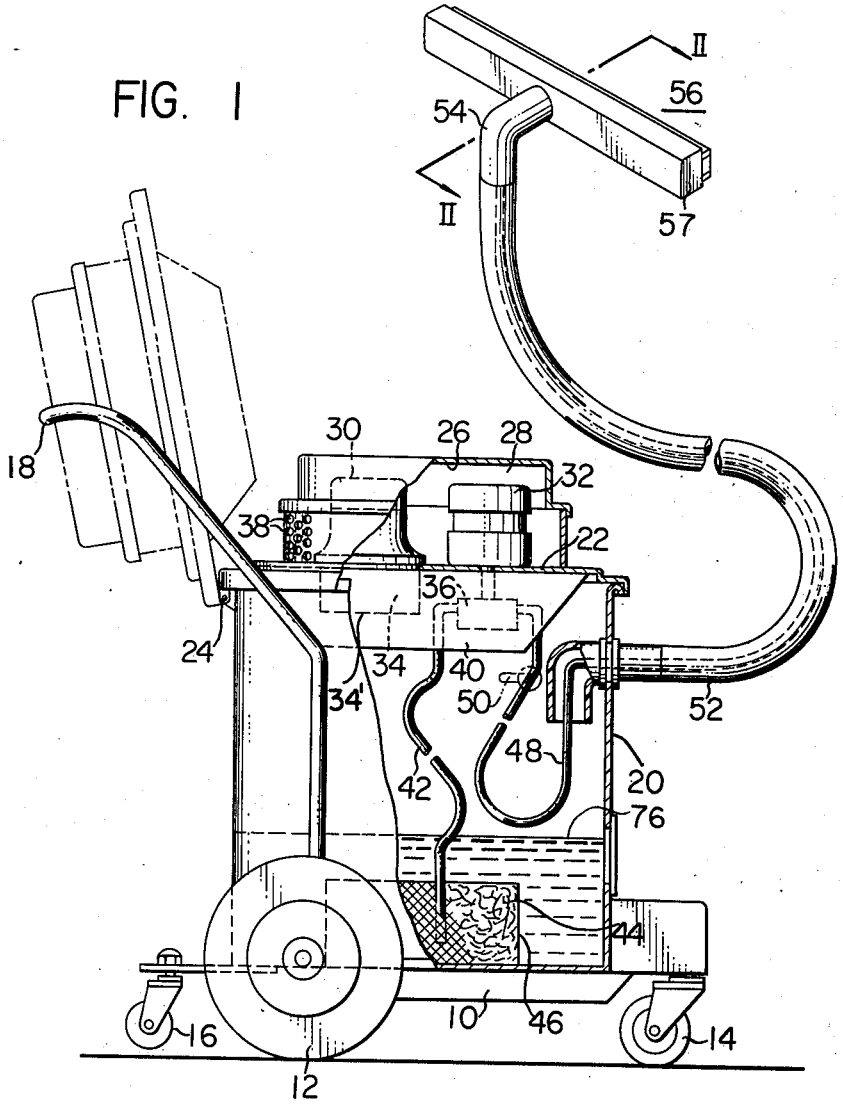
FIG. 1 is a side elevational view of a device for cleaning window glass constructed in accordance with the principles of the present invention with parts broken away and with parts illustrated in perspective.

In a preferred embodiment of the present invention shown in FIG. 1, a horizontal carrier 10 comprises a pair of opposing wheels 12 (only one of which is illustrated) which have a relatively large diameter and which are rotatably secured to the carrier 10 at a lefthand end portion as viewed in FIG. 1, and a single wheel 14 of small diameter which is rotatably secured to the carrier at the end opposite the wheels 12. The small wheel 14 is capable of being horizontally swivelled. Another single wheel 16, smaller in diameter than the wheel 14, is rotatably secured to a plate extending from the lefthand end of the carrier 10. The smaller wheel 16 is normally in a floating state and is capable of being horizontally swivelled. The carrier 10 is further provided with a handle 18. Thus one can push the handle 18 to move the carrier 10 to any desired position.

An upright tank 20 is disposed on the carrier 10 by having its bottom fixedly secured to the upper surface of the carrier 10. The tank 20 has an upper end open and a closed bottom. A cover plate 22 is hinged to the upper end of the tank 20 at 24 to open and hermetically close the upper open end of the tank 20.

The cover plate 22 has a casing 26 attached to the cover plate 22 on the outer or exposed surface to define the machine room 28 above the cover plate 22. Disposed within the machine 28 are a pair of electric motors 30 and 32 operatively coupled to an air exhaust means 34 such as a blower and a water pump 36 attached to the inner surface of the cover plate 22 directly below the motors 30 and 32 respectively. As shown in FIG. 1, a multiplicity of air exhaust holes 38 are provided on the peripheral wall portion of the casing 26 adjacent to the blower 34. The blower and pump 34 and 36 respectively are enclosed within an air filter 40 of trapezoidal cross section attached to the cover plate 22 on the lower or inner surface thereof. The air filter 40 is formed of a suitable synthetic resin sintered into a porous material. The blower 34 includes an air exhaust port 34' opening into the machine room 28.

The water pump 36 includes a suction port connected to a water suction hose 42 hermetically extending through the air lower surface of the filter 40 until it opens in the interior of a dirt percolator 44 disposed in a porous box 46 disposed at the bottom of the tank 20. The dirt percolator 44 is preferably of nylon fibers. The pump 36 includes a delivery port connected to a water feed hose 48 hermetically extending through the air filter 40. In order to control a flow rate of water flowing through the hose 48, a control valve 50 is connected in the hose 48.

A return hose 52 having a relatively large diameter is shown in FIG. 1 as having one end extending and sealed through the peripheral wall of the tank 20 so that the end opens in the tank 20 above the dirt percolator 44. The water feed hose 48 from the pump 36 extends through the return hose 52. The hose 52 includes the other end connected to an L-shaped air-water suction tube 54 subsequently connected to the central portion of a bottom surface of a glass cleaner generally designated by the reference numeral 56.

The glass cleaner 56 includes an elongated channel member 58 closed at the opposite ends and an air-water suction trough 60 substantially coextensive with the channel member 58 and also closed at both ends. The trough 60 has a pair of opposite side walls supported between the opposite longitudinal edge portions of the channel member 58 through respective rubber plates 62 and includes a central opening longitudinally extending through its bottom and a plurality of discrete holes 64 longitudinally disposed on the bottom. A flat, short, water supply tube 66 opens in the central opening on the bottom of the suction trough 60 and has an upstream side abutting the inner bottom surface of the channel member 58. The water supply tube 66 includes a circularly tubular portion from the center of the upstream side projecting into the L-shaped tube 54 and is connected via connection means to the hose 48 from the pump 36.

Figure 2:
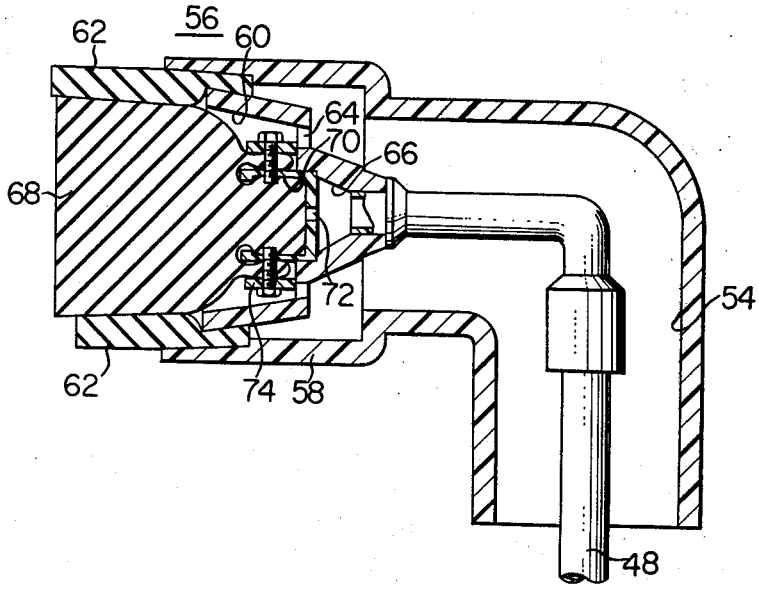
FIG. 2 is a sectional view taken along the line II—II of FIG. 1 with parts illustrated in elevation.

As shown in FIG. 2, a sponge member 68 is sandwiched between the rubber plates 62 projecting beyond the edges of the channel member 58. These rubber plates 62 rinse and clean the window glass. A U-shaped sponge holder 70 substantially coextensive with the tube 66 has a bottom snugly fitted into the open end of the tube 66 and has a pair of leg portions forced into a pair of parallel notches on the rear or upstream end surface of the sponge member 68. The sponge holder 70 is provided on the bottom with a central slit 72. A pair of push strips 74 sides of the sponge holder 60 push both outsides of the sponge member 68 toward the sponge holder 70 and are fastended to the holder 70 by means of bolts with one portion of the sponge member 68 sandwiched therebetween.

The assembly of the cover plate 22, the casing 26 and the air filter 40 can be moved from its position illustrated at the solid line in FIG. 1 to its position illustrated at the broken line in FIG. 1 to open the upper end of the tank 20. When the cover plate is lifted, an amount of water can be charged into the tank 20 so that a water level 76 is positioned between the open end of the return hose 52 and the dirt percolator 44, after which the assembly as above described is returned to its position illustrated as a solid line in FIG. 1 to hermetically close the upper end of the tank 20. Thus the arrangement is ready for the cleaning operation. When the blower 34 and the pump 36 are started, the blower 34 sucks the air within the tank 20 and exhausts it through the exhaust port and holes 34' and 38 respectively and decreases the air pressure within the tank 20.

Then, the free end surface of the sponge member 68 is put into contact with the glass panel to be cleaned. This results in the closure of the air inflow path from the cleaner 56 to the tank 22. Thus, a negative pressure is built up in the air-water suction tube 54. Under these circumstances air does not move, but water is pumped, by the pump 36, from the tank 20 through the hose 48 and fills the sponge member 68 until the water reaches the glass panel. In this connection, it is noted that even though a vacuum is formed in the suction tube 54 the tube cannot suck water within the suction trough 60 thereinto.

The glass cleaner 56 is then moved downwardly along the glass panel while the free end surface thereof and extremities of the rubber plates 62 are maintained in compression contact with the glass panel. During the downward movement of the glass cleaner 54 the upper rubber plate 52 (as viewed in FIG. 2) is upwardly bent to form a vent spacing between it and the sponge member 68. Air is then sucked into the suction tube 54 through this vent spacing between the sponge and upper rubber plate.

The water reaching the glass panel rinses the glass panel and picks up the dirt that was attached to the glass panel. The sucked air traps this contaminated water and this air-water mixture enters the suction tube 54 and the suction hose 52 and is delivered into the tank 20.

Within the tank 20, the dirty water falls upon the water charged in the tank 20 and is percolated by the dirt percolator 44 and cleaned after which the cleaned water is again fed to the pump 36. On the other hand, the sucked air is filtered by the air filter 40 and then externally exhausted by the blower 34 in the manner as above described.

The present invention has several advantages. For example, the cleaning water is prevented from being wasted because the dirty water returned back to the tank 20 is percolated by the dirt percolator 44 and converted to clean water that is repeatedly fed to the glass cleaner 56. Also the operation of cleaning window glass is sanitarily performed because the air sucked into the tank 20 is separated from dust, dirt and moisture by the air filter 40. The air thus cleaned is exhausted externally of the device by the blower 34. Further, the components disposed within the tank 20 are simplified in construction and are simple and easy to handle. In addition, the air exhaust blower and water pump along with the electric motors therefor are disposed on the cover plate 22 resulting in the facilitation of the maintenance and control.

While the present invention has been illustrated and described in conjunction with a single preferred embodiment thereof it is to be understood that numerous changes and modifications in the details, construction and arrangement of the parts may be resorted to without departing from the spirit and scope thereof.

What is claimed is:

1. A device for cleaning window glass with a liquid comprising:

an upright tank means having an open top and a closed bottom for containing said liquid therein;

cover plate means over said open top for hermetically closing said top;

exhaust means mounted on said cover plate means and communicating with the inside of said tank means for exhausting the air within said tank means therefrom, thereby creating at least a partial vacuum in said tank means;

pumping means mounted on said cover plate means for pumping said liquid from said tank means;

air filter means on said cover plate means between said exhaust means and the inside of said tank means for filtering the air exhausted from said tank means by said exhaust meand;

a dirt percolator at the bottom of said tank in said liquid;

a water suction hose extending from the inside of said dirt percolator to said pumping means;

cleaning head means for pressing against said window glass and cleaning it;

water feed hose means extending from said pump means to said cleaning head for providing water from said tank means to said cleaning head means; and a return hose means extending from said cleaning head means to said tank means above said liquid in said tank means for returning the water supplied to said cleaning head means to said tank means;

said cleaning head means being comprised of:

an air-water suction tube connected to said return hose means at one end, an elongated channel member connected to and communicated with said suction tube at the end thereof opposite the end connected to said return hose, an air-water suction trough within and spaced from said channel member said trough having a central opening and a plurality of discrete openings through the bottom thereof, a plurality of rubber plates between said channel member and said suction trough extending outward from said channel member, a water supply tube connected to the bottom of said suction trough in communication with said central opening therethrough, said water supply tube being open at one end into said trough and connected to said water feed hose means, a sponge member sandwiched between said rubber plates and projecting beyond the end of said channel member, a sponge holder fitted into said open end of said water supply tube and having said sponge member fitted thereinto, and sponge holder means connected to said trough for holding said sponge member in said sponge holder.

2. A device as claimed in claim 1, wherein said air filter means is comprised of a synthetic resin sintered into a porous material.

3. A device as claimed in claim 1, wherein said air filter means is positioned between said pumping means and the inside of said tank means, said water suction hose to said pumping means and said water feed hose means from said pumping means passing through said filter means.

4. A device as claimed in claim 1, further comprising carrier means at the bottom of said tank means for moving said tank means about.

5. A device as claimed in claim 1, wherein said water feed hose means connected to said cleaning head means is contained within said return hose means.

* * * * *